US005232614A

United States Patent [19]

Colclough et al.

[11] Patent Number: 5,232,614

[45] Date of Patent: Aug. 3, 1993

[54] LUBRICATING OIL COMPOSITIONS AND ADDITIVES FOR USE THEREIN

[75] Inventors: Terence Colclough, Abingdon, United Kingdom; Andrew J. D. Ritchie, Chatham, N.J.

[73] Assignee: Exxon Chemical Patents Inc., Linden, N.J.

[21] Appl. No.: 783,708

[22] Filed: Oct. 24, 1991

Related U.S. Application Data

[63] Continuation of Ser. No. 484,926, Feb. 23, 1990, abandoned.

[30] Foreign Application Priority Data

Feb. 23, 1989 [GB] United Kingdom ..... 8904203

[51] Int. Cl.[5] ..... C10M 133/04

[52] U.S. Cl. ..... 252/32.7 E; 252/50; 252/51.5 A; 252/25; 252/33.4

[58] Field of Search ..... 252/50, 51.5 A, 32.7 E, 252/40, 25, 33.4

[56] References Cited

U.S. PATENT DOCUMENTS

| | | | |
|---|---|---|---|
| 2,451,642 | 10/1948 | Watson | 252/50 |
| 3,230,257 | 1/1966 | Schmerling | 260/576 |
| 4,032,462 | 6/1977 | Hotten et al. | 252/49.7 |
| 4,292,195 | 9/1981 | Morris | 252/401 |
| 4,456,541 | 6/1984 | Wright | 252/50 |
| 4,568,711 | 2/1986 | Kay et al. | 252/401 |
| 4,693,837 | 9/1987 | Dixon | 252/50 |
| 4,711,737 | 12/1987 | Bargoyne, Jr. | 252/50 |
| 4,904,401 | 2/1990 | Ripple et al. | 252/32.7 E |

FOREIGN PATENT DOCUMENTS

| | | |
|---|---|---|
| 0225580 | 6/1987 | European Pat. Off. . |
| 53-51206 | 5/1978 | Japan . |
| 563910 | 9/1944 | United Kingdom . |
| 727247 | 3/1955 | United Kingdom . |
| 728509 | 4/1955 | United Kingdom . |
| 760315 | 10/1956 | United Kingdom . |
| 916553 | 1/1963 | United Kingdom . |
| 1357744 | 6/1974 | United Kingdom . |
| 1371470 | 10/1974 | United Kingdom . |
| 1502619 | 3/1978 | United Kingdom . |
| 1502622 | 3/1978 | United Kingdom . |

*Primary Examiner*—Jacqueline V. Howard
*Attorney, Agent, or Firm*—M. B. Kapustij; E. R. Skula

[57] ABSTRACT

Substituted para-phenylene diamines have been found to be effective antioxidants capable of protecting crankcase lubricating oils from thickening and sludge formation after prolonged exposure to oxygen at elevated temperature.

22 Claims, No Drawings

LUBRICATING OIL COMPOSITIONS AND ADDITIVES FOR USE THEREIN

This is a continuation of application Ser. No. 484,926, filed Feb. 23, 1990, now abandoned.

This invention relates to lubricating oil compositions containing anti-oxidants and to additives for use therein.

Crankcase lubricating oils used in internal combustion engines in automobiles and trucks rapidly become contaminated, in use, with iron compounds which catalyse oxidation of the oil. This oxidation, which is also promoted by the elevated temperatures to which the oils are subjected, contributes to the formation of undesirable sludge and also causes the oil to thicken or even solidify. It is therefore usual to include in crankcase lubricants an antioxidant to improve the useful life of the oil by reducing sludge formation and thickening. In recent years, the requirements for antioxidants for use in such oils have become more stringent, more particularly because gasoline and diesel engines are often operated at higher running temperatures than heretofore, and this increases the rate of oxidation of oils used therein. Also, base stocks used in preparation of commercial crankcase lubricating oils are often of poorer quality in terms of their resistance to oxidation, and consequently need greater protection. Further, there is a tendency for oils to be used in engines for longer periods, (e.g. because of longer service intervals) and this again requires greater resistance of the oil to oxidation. One of the standard tests used for assessing the oxidation resistance of lubricants for use in gasoline oils, the so-called Sequence IIID test, has recently been replaced by the sequence IIIE test which requires greater oxidation resistance of the lubricant oil. In addition, it is desirable to use antioxidants of environmentally acceptable composition. In this connection, some known antioxidants contain phosphorus and there is currently a desire to reduce the phosphorus content of lubricating oils by replacing known phosphorus containing antioxidants by phosphorus free antioxidants.

The invention is concerned with the problem of providing an improved antioxidant for use in an environment in which iron-catalysed oxidation reactions can take place. More particularly, the invention is concerned with the problem of providing an improved antioxidant for crankcase lubricating oils while maintaining the balance of other properties of such oils, such as sludge and wear control.

We have now discovered that certain substituted para-phenylene diamines are highly effective antioxidants for incorporation in lubricating oil compositions for use in environments in which iron-catalysed oxidation reactions can take place, e.g. lubricant oils for gasoline and diesel engines.

There have been a number of proposals to include certain para-phenylene diamine derivatives in various substances to promote the stability of such substances during storage and/or use. Proposals of this type are found in British Patent Specifications Nos. 563 910, 727 247, 728 509, 760 315, 916 553, 1 357 744, 1 502 619 and 1 502 622. There is, however no disclosure in any of these specifications of using the substituted paraphenylene diamines with which the present invention is concerned as antioxidants for lubricants for use in environments in which iron-catalysed oxidation reactions can occur. Further, the fact that certain compounds have been proposed for improving, for example, the stability of a substance which is stored or used under relatively mild conditions and/or under conditions where iron compounds are not present is of no assistance for solving the problem of providing improved antioxidants for lubricating oils which in use are subjected to high temperatures and other hostile conditions and, in particular, are contaminated in use with iron compounds. It is surprising that the particular para-phenylene diamines with which the invention is concerned provide improved antioxidant properties compared with, for example, the diphenylamines which have previously been proposed for use under these conditions.

The present invention accordingly provides a lubricating oil composition for use in an environment in which iron-catalysed oxidation reactions can take place, which composition comprises, as antioxidant, a paraphenylene diamine of the formula:

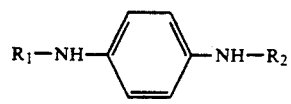

in which $R_1$ and $R_2$ are the same or different and each represents an alkyl or alkenyl radical of up to 20 carbon atoms, a cycloalkyl or cycloalkenyl radical of 5 to 7 carbon atoms optionally substituted by one or more alkyl or alkenyl radicals of up to 20 carbon atoms each, an aryl radical, an aryl radical substituted by one or more alkyl or alkenyl radicals of up to 20 carbon atoms each, or an aryl-alkyl or aryl-alkenyl radical with up to 20 carbon atoms in the alkyl or alkenyl residue and optionally substituted on the aryl moiety by one or more alkyl or alkenyl radicals of up to 20 carbon atoms each, the said para-phenylene diamine being present as the free base or as an oil-soluble salt. [In the foregoing general formula, the aryl radicals are preferably phenyl radicals and the alkyl radicals may by straight or branched chain.]

Preferably at least one of $R_1$ and $R_2$ in the above formula represents a cycloaliphatic or aryl-containing radical as specified above, and advantageously at least one of $R_1$ and $R_2$ represents an aryl radical, preferably a phenyl radical, optionally substituted by one or more alkyl or alkenyl radicals having up to 20 carbon atoms each. More preferably, the radical $R_1$ is phenyl or alkyl-phenyl with 3 to 18, preferably 6 to 12, carbon atoms in the alkyl group, and $R_2$ is an alkyl group of 3 to 18, preferably 6 to 12, carbon atoms, cyclohexyl, phenyl, or alkyl-phenyl with 3 to 18, preferably 6 to 12, carbon atoms in the alkyl group.

Some of the para-phenylene diamines which may be used in accordance with the invention are known compounds which are commercially available. One such compound is that sold under the trademark Santoflex 134 by Monsanto. This is a para-phenylene diamine of the formula given above in which $R_1$ is phenyl, and $R_2$ is a mixture of 1,4-dimethylpentyl and 1,3-dimethylbutyl in the approximate ratio of 2:1.

The above-defined para-phenylene diamines are effective antioxidants in lubricating oils in a concentration in the range of 0.1 to 0.5% by weight based on the total weight of the oil. At such levels, the para-phenylene diamines have been found to be remarkably effective as inhibiting both oxidation and nitration which are thought to be involved not only in oil thickening but also in the formation of sludge when oils are used in an environment in which iron-catalysed reactions can take place.

Lubricating oil compositions for use in an iron-catalysed environment, e.g. heavy duty oils suitable for gasoline and diesel engines, can be prepared using the compositions of this invention. Universal type crankcase oils, those in which the same lubricating oil compositions are used for either gasoline or diesel engines, may also be prepared. These lubricating oil formulations conventionally contain several different types of additives that will supply the characteristics that are required for the particular use. Among these types of additives are included viscosity index improvers, corrosion inhibitors, detergents, dispersants, pour point depressants and antiwear additives. Other antioxidants besides the antioxidants of the invention may also be included.

In the preparation of lubricating oil formulations, it is common practice to introduce the additives in the form of a concentrate (a so-called "package" or "ad pack") containing 2.5 to 90 weight percent, e.g. 5 to 75 weight percent, active ingredient in a solvent. The solvent may be a hydrocarbon oil, e.g. a mineral lubricating oil, or other suitable material. In forming finished lubricants, such as crankcase motor oils, these concentrates, in turn, may be diluted with 3 to 100 parts by weight of lubricating oil, and preferably in the proportions of 5 to 15 parts by weight of the additive package to 95–85 parts by weight of the lubricating oil. The use of concentrates makes the handling of the various constituent materials less difficult and facilitates dissolution, or dispersion, of those materials in the final blend. Blending of lubricating oil composition containing several types of additives typically causes no problems if each additive is added separately.

Compositions for use in an environment in which iron-catalysed oxidation reactions can take place contain, in addition to the para-phenylene diamine antioxidant, also one or more of the following:

a. a dispersant, preferably an ashless dispersant;
b. a detergent, preferably having a high total base number;
c. an antiwear additive;
d. a viscosity index improver, which may also have dispersant properties;
e. A pour point depressant;
f. A corrosion inhibitor and/or metal deactivator; and
g. A friction modifier or fuel economy agent.

Other antioxidants may also be present. Such compositions preferably contain at least an ashless dispersant and/or a viscosity index improver dispersant, a detergent, and an antiwear additive in amounts effective to provide their respective functions.

The compositions of the invention, which may be, for example, automotive lubricating oil compositions, and particularly crankcase lubricants, may comprise a major amount of a base lubricating oil. Broadly, the composition may contain from 80 to 99 weight percent of lubricating oil, and preferably from 85 to 95 weight percent of lubricating oil. The term "lubricating oil" includes not only hydrocarbon oils derived from petroleum but also synthetic oils such as alkyl esters of dicarboxylic acids, polyglycols and alcohols, polyalphaolefins, alkyl benzenes, organic esters of phosphoric acids, silicone oils, etc.

When the compositions of this invention are provided in the form of concentrates, a minor amount, e.g. up to about 50 percent by weight, of a solvent, mineral or synthetic oil may be included to improve the handling properties of the concentrate.

DISPERSANTS

The preferred ashless dispersant in the compositions of this invention is a long chain hydrocarbyl substituted mono- or di- carboxylic acid material, i.e. acid, anhydride, or ester, and includes a long chain hydrocarbon, generally a polyolefin, substituted with an alpha or beta unsaturated $C_4$ to $C_{10}$ carboxylic acid material, such as itaconic acid, maleic acid, maleic anhydride, chloromaleic acid, dimethyl fumarate, chloromaleic anhydride, acrylic acid, methacrylic acid, crotonic acid, cinnamic acid, etc. Preferably, the dispersant contains at least about 1.05 moles (e.g., 1.05 to 1.2 moles, or higher) of the acid material per mole of polyolefin. The proportion of the dispersant is preferably from 1 to 10 and especially 3 to 7 weight percent of the lubricating oil.

Preferred olefin polymers for the reaction with carboxylic acids are polymers derived from a $C_2$ to $C_{10}$, e.g. $C_2$ to $C_5$, monoolefin. Such olefins include ethylene, propylene, butylene, isobutylene, pentene, octene-1, styrene, etc. The polymers may be homopolymers such as polyisobutylene or copolymers of two or more of such olefins. These include copolymers of: ethylene and propylene; butylene and isobutylene; propylene and isobutylene; etc. Other copolymers include those in which a minor molar amount of the copolymer monomers, e.g. 1 to 10 mole percent, is a $C_4$ to $C_{18}$ diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers usually have number average molecular weights above about 700, including number average molecular weights within the range of from 1,500 to 5,000 with approximately one double bond per polymer chain. An especially suitable starting material for a dispersant additive is polyisobutylene. The number average molecular weight for such polymers can be determined by several known techniques. A convenient method for such determination is by gel permeation chromatography (GPC) which additionally provides molecular weight distribution information, see W. W. Yua, J. J. Kirkland and D. D. Bly, "Modern Size Exclusion Liquid Chromatography," John Wiley and Sons, New York, 1979.

Processes for reacting the olefin polymer with the unsaturated carboxylic acid, anhydride, or ester are known in the art. For example, the olefin polymer and the carboxylic acid material may be simply heated together as disclosed in U.S. Pat. Nos. 3,361,673 and 3,401,118 to cause a thermal "ene" reaction to take place. Or, the olefin polymer can be first halogenated, for example chlorinated or brominated, to about 1 to 8, preferably 3 to 7, weight percent chlorine or bromine, based on the weight of polymer, by passing chlorine or bromine through the polyolefin at a temperature of 100° to 250° C., e.g. 120° to 160° C., for about 0.5 to 10, preferably 1 to 7, hours. The halogenated polymer may then be reacted with sufficient unsaturated acid or anhydride at 100° to 250° C., usually 180° to 220° C., for from 0.5 to 10, e.g. 3 to 8, hours. Processes of this general type are taught in U.S. Pat. Nos. 3,087,436; 3,172,892; 3,272,746 and others.

Alternatively, the olefin polymer, and the unsaturated acid or anhydride are mixed and heated while chlorine is added to the hot material. Processes of this type are disclosed in U.S. Pat. Nos. 3,215,707; 3,231,587; 3,912,764; 4,110,349; 4,234,435; and GB-A- 1 440 219.

When a halogen is used, from 65 to 95 weight percent of the polyolefin normally reacts with the carboxylic acid or anhydride. Thermal reactions, carried out without the use of halogen or a catalyst, cause only from 50 to 75 weight percent of the polyisobutylene to react. Chlorination increases reactivity.

The carboxylic acid or anhydride can then be further reacted with amines, alcohols, including polyols, amino-alcohols, etc., to form other useful dispersant additives. Thus, if the acid or anhydride is to be further reacted, e.g., neutralized, then generally a major proportion of at least 50 percent of the acid units up to all the acid units will be reacted.

Useful amine compounds for reaction with the hydrocarbyl substituted carboxylic acid or anhydride include mono- and polyamines of from 2 to 60, e.g., 3 to 20, total carbon atoms and from 1 to 12, e.g., 2 to 8, nitrogen atoms in a molecule. These amines may be hydrocarbyl amines or may be hydrocarbyl amines including other groups, e.g., hydroxy groups, alkoxy groups, amide groups, nitriles, imidazoline groups, and the like. Hydroxy amines with 1 to 6 hydroxy groups, preferably 1 to 3 hydroxy groups, are particularly useful. Preferred amines are aliphatic saturated amines, including those of the general formulae:

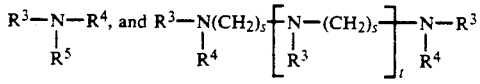

wherein $R^3$, $R^4$ and $R^5$ are each hydrogen; $C_1$ to $C_{25}$ straight or branched chain alkyl radicals; $C_1$ to $C_{12}$ alkoxy-($C_2$ to $C_6$ alkylene) radicals; $C_2$ to $C_{12}$ alkylamino-($C_2$ to $C_6$ alkylene) radicals; each s can be the same or a different number of from 2 to 6, preferably 2 to 4; and t is a number of from 0 to 10, preferably 2 to 7. At least one of $R^3$, $R^4$ and $R^5$ must be hydrogen.

Suitable amines include: 1,2-diaminoethane; 1,3-diaminopropane: 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene)triamine; di(1,3-propylene)-triamine; N,N-dimethyl-1,3-diaminopropane; N,N-di-(2-aminoethyl) ethylene diamine; N,N-di(2-hydroxyethyl)-1,3-propylene diamine; 3-dodecyloxypropylamine; N-dodecyl-1,3-propane diamine; tris hydroxymethylaminomethane (THAM); diisopropanol amine; diethanol amine; triethanol amine; amino morpholines such as N-(3-amino-propyl) morpholine; etc.

Other useful amine compounds include: alicyclic diamines such as 1,4-di-(aminomethyl) cyclohexane, and heterocyclic nitrogen compounds such as imidazolines, and N-aminoalkyl piperazines of the general formula:

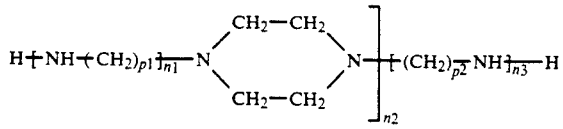

wherein $p^1$ and $p^2$ are the same or different and each is an integer from 1 to 4, and $n_1$, $n_2$ and $n_3$ are the same or different and each is an integer from 1 to 3. Examples of such amines include 2-pentadecyl imidazoline and N-(2-aminoethyl) piperazine.

Hydroxyamines which can be reacted with the long chain hydrocarbon substituted dicarboxylic acid material mentioned above to form dispersants include 2-amino-1-butanol, 2-amino-2-methyl-1-propanol, p-(betahydroxyethyl)-aniline, 2-amino-1-propanol, 3-amino-1-propanol, 2-amino-2-methyl-1,3-propanediol, 2-amino-2-ethyl-1,3-propanediol, N-(beta-hydroxy propyl)-N'-(beta-aminoethyl)-piperazine, ethanolamine, beta-(beta-hydroxyethoxy)-ethylamine, and the like. Mixtures of these or similar amines can also be employed.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly (ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

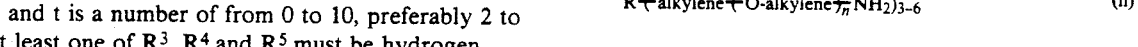

(i)

where m has a value of from 3 to 70, preferably 10 to 35; and

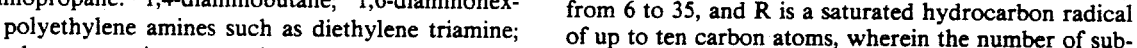

(ii)

where n has a value of about 1 to 40, with the provision that the sum of all the n's is from 3 to 70 and preferably from 6 to 35, and R is a saturated hydrocarbon radical of up to ten carbon atoms, wherein the number of substituents on the R group is from 3 to 6. The alkylene groups in either formula (i) or (ii) may be straight or branched chains containing about 2 to 7, and preferably about 2 to 4, carbon atoms.

The polyoxyalkylene polyamines above, preferably polyoxyalkylene diamines and polyoxyalkylene triamines, may have average molecular weights ranging from 200 to 4,000 and preferably from 400 to 2,000. The preferred polyoxyalkylene polyamines include the polyoxyethylene and polyoxypropylene diamines and the polyoxypropylene triamines having average molecular weights ranging from 200 to 2,000. The polyoxyalkylene polyamines are commercially available and may be obtained, for example, from the Jefferson Chemical Company, Inc. under the trade name "Jeffamines D-230, D-400, D-1000, D-2000, T-403," etc.

The amine is readily reacted with the carboxylic acid material, e.g., alkenyl succinic anhydride, by heating an oil solution containing 5 to 95 weight percent of carboxylic acid material to from 100° to 250° C., preferably 125° to 175° C., generally for 1 to 10, e.g. 2 to 6, hours, until the desired amount of water has been removed. The heating is preferably carried out to favour formation of imides, or mixtures of imides and amides, rather than amides and salts. Reaction ratios can vary considerably, depending upon the reactants, amounts of excess amine, type of bonds formed, etc. Generally from 0.3 to 2, preferably from 0.3 to 1.0, e.g. 0.4 to 0.8, mole of amine, e.g. bis-primary amine, is used, per mole of the carboxylic acid moiety content, e.g. grafted maleic anhydride content. For example, one mole of olefin reacted with sufficient maléic anhydride to add 1.10 mole of maleic anhydride groups per mole of olefin when converted to a mixture of amides and imides, about 0.55 moles of amine with two primary groups would preferably be used, i.e., 0.50 mole of amine per mole of dicarboxylic acid moiety.

The nitrogen containing dispersant can be further treated by boration as generally taught in U.S. Pat. Nos. 3,087,936 and 3,254,025.

Tris (hydroxymethyl) amino methane (THAM) can be reacted with the aforesaid acid material to form amides, imides or ester type additives as taught by GB-A- 984 409, or to form oxazoline compounds and borated oxazoline compounds as described, for example, in U.S. Pat. No. 4,102,798, 4,116,876 and 4,113,639.

The ashless dispersants may also be esters derived from the long chain hydrocarbyl substituted carboxylic acid material and from hydroxy compounds such an monohydric and polyhydric alcohols or aromatic compounds such as phenols and naphthols, etc. The polyhydric alcohols are the most preferred hydroxy compound and preferably contain from 2 to 10 hydroxy radicals, for example, ethylene glycol, diethylene glycol, triethylene glycol, tetraethylene glycol, dipropylene glycol, and other alkylene glycols in which the alkylene radical contains from 2 to 8 carbon atoms. Other useful polyhydric alcohols include glycerol, mono-oleate of glycerol, monostearate of glycerol, monomethyl ether of glycerol, pentaerythritol, dipentaerythritol, etc.

The ester dispersant may also be derived from unsaturated alcohols such as allyl alcohol, cinnamyl alcohol, propargyl alcohol, 1-cyclohexane-3-ol, and oleyl alcohol. $till other classes of alcohols capable of yielding the esters of this invention comprise the ether-alcohols and amino-alcohols including, for example, the oxy-alkylene, oxy-arylene-, amino-alkylene-, and amino-arylene-substituted alcohols having one or more oxy-alkylene, amino-alkylene or amino-arylene or amino-arylene oxy-arylene radicals They are exemplified by Cellosolve, Carbitol, N,N,N',N'-tetrahydroxy-tri-methylene diamine, and ether-alcohols having up to about 150 oxy-alkylene radicals in which each alkylene radical contains from 1 to 8 carbon atoms.

The ester dispersant may be a di-ester of succinic acid or an acidic ester, i.e. a partially esterified succinic acid; or a partially esterified polyhydric alcohol or phenol, i.e., an ester having free alcoholic or phenolic hydroxyl radicals. Mixtures of the above illustrated esters are likewise contemplated within the scope of this invention.

The ester dispersant may be prepared by one of several known methods as illustrated for example in U.S. Pat. No. 3,381,022.

Mannich base type dispersants such as those described in U.S. Pat. No. 3,649,229 and 3,798,165 may also be used in these compositions Such Mannich base dispersants can be formed by reacting a high molecular weight, hydrocarbyl-substituted mono- or polyhydroxy benzene (e.g., having a number average molecular weight of 1,000 or greater) with amines (e.g., polyalkyl polyamines, polyalkenyl polyamines, aromatic amines, carboxylic acid-substituted polyamines and the succinimide formed from any one of these with an olefinic succinic acid or anhydride) and carbonyl compounds (e.g. formaldehyde or para formaldehyde).

A very suitable dispersant is one derived from polyisobutylene substituted with succinic anhydride groups and reacted with polyethylene amines, e.g., tetraethylene pentamine, pentaethylene hexamine, polyoxyethylene and polyoxypropylene amines, e.g., polyoxypropylene diamine, trismethylolaminomethane and pentaerythritol, and combinations thereof One preferred dispersant combination involves a combination of (A) polyisobutene substituted with succinic anhydride groups and reacted with (B) a hydroxy compound, e.g., pentaerythritol, (C) a polyoxyalkylene polyamine, e.g., polyoxypropylene diamine, and (D) a polyalkylene polyamine, e.g., polyethylene diamine and tetraethylene pentamine using from 0.3 to 2 moles each of (B) and (D) and from 0.3 to 2 moles of (C) per mole of (A) as described in U.S. Pat. No. 3,804,763.

Another preferred dispersant combination involves the combination of (A) polyisobutenyl succinic anhydride with (B) a polyalkylene polyamine, e.g., tetraethylene pentamine, and (C) a polyhydric alcohol or polyhydroxy-substituted aliphatic primary amine, e.g., pentaerythritol or trismethylolaminomethane as described in U.S. Pat. No. 3,632,511.

DETERGENTS

Metal-containing rust inhibitors and/or detergents are frequently used with ashless dispersants. Such detergents and rust inhibitors include oil soluble mono- and di-carboxylic acids, the metal salts of sulfonic acids, alkyl phenols, sulfurized alkyl phenols, alkyl salicylates and napthenates. Highly basic (or "over-based") metal salts, which are frequently used as detergents, appear particularly prone to promote oxidation of hydrocarbon oils containing them. Usually these metal-containing rust inhibitors and detergents are used in lubricating oil in amounts of from 0.01 to 10, e.g., 0.1 to 5, weight percent, based on the weight of the total lubricating composition.

Highly basic alkali metal and alkaline earth metal sulfonates are frequently used as detergents. They are usually produced by heating a mixture comprising an oil-soluble sulfonate or alkaryl sulfonic acid, with an excess of alkali metal or alkaline earth metal compound above that required for complete neutralization of any sulfonic acid present and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms. For example, haloparaffins, olefins obtained by dehydrogenation of paraffins, polyolefin polymers produced from ethylene, propylene, etc., are all suitable. The alkaryl sulfonates usually contain from 9 to 70 or more carbon atoms, preferably from 16 to 50 carbon atoms per alkyl substituted aromatic moiety.

The alkali metal or alkaline earth metal compounds which may be used in neutralizing these alkaryl sulfonic acids to provide the sulfonates include the oxides and hydroxides, alkoxides, carbonates, carboxylates, sulfides, hydrosulfides, nitrates, borates and ethers of sodium, magnesium, calcium, strontium and barium. Examples are calcium oxide, calcium hydroxide, magnesium oxide, magnesium acetate and magnesium borate. As noted, the alkaline earth metal compound is used in excess of that required to complete neutralization of the alkaryl sulfonic acids. Generally, the amount ranges from 100 to 220 percent, although it is preferred to use at least 125 percent of the stoichiometric amount of metal required for complete neutralization.

Various other preparations of basic alkali metal and alkaline earth metal alkaryl sulfonates are known, such as U.S. Pat. Nos. 3,150,088 and 3,150,089 wherein overbasing is accomplished by hydrolysis of an alkoxide-carbonate complex with the alkaryl sulfonate in a hydrocarbon solvent-diluent oil.

Preferred alkaline earth sulfonate additives are magnesium alkyl aromatic sulfonate having a high total base number as measured by ASTM 02896 ("TBN") ranging from 300 to 400 with the magnesium sulfonate content ranging from 25 to 32 weight percent, based upon the total weight of the additive system dispersed in mineral lubricating oil, and calcium alkyl aromatic sulfonates having a TBN of at least 250, preferably 300–400.

Neutral metal sulfonates are frequently used as rust inhibitors. Polyvalent metal alkyl salicylate and naphthenate materials are known additives for lubricating oil compositions to improve their high temperature performance and to counteract deposition of carbonaceous matter on pistons (U.S. Pat. No. 2,744,069). An increase in reserve basicity of the polyvalent metal alkyl salicylates and napthenates can be realized by utilizing alkaline earth metal, e.g. calcium, salts of mixtures of $C_8$–$C_{26}$ alkyl salicylates and phenates (see '069) or polyvalent metal salts of alkyl salicylic acids, said acids obtained from the alkylation of phenols followed by phenation, carboxylation and hydrolysis (U.S. Pat. No. 3,704,315) which could then be converted into highly basic salts by techniques generally known and used for such conversion. The reserve basicity of these metal-containing rust inhibitors is useful at TBN levels of between 60 and 150. Included with the useful polyvalent metal salicylate and naphthenate materials are the methylene and sulfur bridged materials which are readily derived from alkyl substituted salicylic or naphthenic acids or mixtures of either or both with alkyl substituted phenols. Basic sulfurized salicylates and a method for their preparation is shown in U.S. Pat. No. 3,595,791. Such materials include alkaline earth metal, particularly magnesium, calcium, strontium and barium, salts of aromatic acids having the general formula:

$$HOOC—ArR_1—Xy(ArR_1OH)_n$$

where Ar is an aryl radical of 1 to 6 rings, $R_1$ is an alkyl group having from 8 to 50 carbon atoms, preferably 12 to 30 carbon atoms (optimally about 12), X is a sulfur (—S—) or methylene (—$CH_2$—) bridge, y is a number from 0 to 4 and n is a number from 0 to 4.

Preparation of the overbased methylene bridged salicylate-phenate salt is readily carried out by conventional techniques such as by alkylation of a phenol followed by phenation, carboxylation, hydrolysis, methylene bridging a coupling agent such as an alkylene dihalide followed by salt formation concurrent with carbonation. An overbased calcium salt of a methylene bridged phenol-salicylic acid of the general formula:

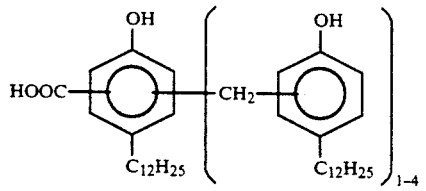

with a TBN of 60 to 150 is for example useful in this invention.

Another type of basic metal detergent, the sulfurized metal phenates, can be considered a metal salt whether neutral or basic, of a compound typified by the general formula:

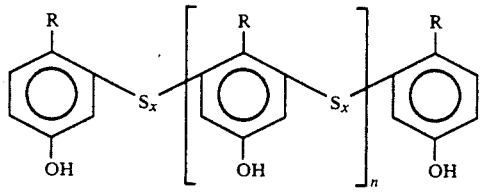

where x=1 or 2, n=0, 1 or 2 or a polymeric form of such a compound, where R is an alkyl radical, n and x are each integers from 1 to 4' and the average number of carbon atoms in all of the R groups is at least about 9 in order to ensure adequate solubility in oil. The individual R groups may each contain from 5 to 40, preferably 8 to 20, carbon atoms. The metal salt is prepared by reacting an alkyl phenol sulfide with a sufficient quantity of metal containing material to impart the desired alkalinity to the sulfurized metal phenate.

Regardless of the manner in which they are prepared, the sulfurized alkyl phenols which are useful generally contain from 2 to 14 percent by weight, preferably 4 to 12 weight percent sulfur based on the weight of sulfurized alkyl phenol.

The sulfurized alkyl phenol may be converted by reaction with a metal-containing material including oxides, hydroxides and complexes in an amount sufficient to neutralize said phenol and, if desired, to overbase the product to a desired alkalinity by procedures well known in the art. Preferred is a process of neutralization utilizing a solution of metal in a glycol ether.

The neutral or normal sulfurized metal phenates are those in which the ratio of metal to phenol nucleus is about 1:2. The "overbased" or "basic" sulfurized metal phenates are sulfurized metal phenates wherein the ratio of metal to phenol is greater than the stoichiometric ratio, e.g. basic sulfurized metal dodecyl phenate has a metal content up to (or greater) than 100 percent in excess of the metal present in the corresponding normal sulfurized metal phenate. The excess metal is produced in oil-soluble or dispersible form (as by reaction with $CO_2$).

The detergents which may be included in the compositions of the present invention may optionally be borated in known manner. Such boration provides the detergent with a measure of anti-wear activity.

It is preferred to use a combination of metal-containing detergents comprising calcium and magnesium salts or calcium, magnesium and sodium salts, as described above.

ANTIWEAR ADDITIVES (INCLUDING EXTREME PRESSURE AGENTS)

A wide variety of anti-wear additives may be included in the compositions of the invention. For example, organic sulphides and polysulphides including especially dialkyl sulphides and polysulphides, e.g. dibutyl polysulphides, and dibenzyl sulphides and polysulphides, which may be substituted, e.g. with halogen, may be incorporated in the compositions. Sulphurized esters, e.g. sulphurized methyl or isopropyl oleate and other sulphurized compounds, e.g. sulphurized olefins such as sulphurized diisobutylene, sulphurized tripropylene or sulphurized dipentene may also be added to the compositions. More complex sulphurized compounds such as sulphurized alkyl phenols and sulphurized terpenes and Diels-Alder adducts and sulphurized polymers, e.g. butadiene/butyl acrylate copolymers, may also be used as may sulphurized tall oil fatty acid esters.

Esters of beta-thiodipropionic acid, e.g. butyl, nonyl, tridecyl or eicosyl esters may also be used.

Anti-wear additives in the form of phosphorus esters, e.g. di- and tri-alkyl, cycloalkyl or aryl phosphites, may also be used. Examples of such phosphites include dibutyl phosphite, dihexyl phosphite, dicyclohexyl phosphite, alkyl phenyl phosphites, higher alkyl phosphites such as tridecyl phosphite or distearyl phosphite, and mixed phosphites such as dimethylphenyl phosphite and mixed higher alkyl, e.g. oleyl, and alkyl phenyl, e.g. 4-pentyl phenyl, phosphite. Phosphites based on polymers such as low molecular weight, polyethylenes and polypropylenes may also be used.

Preferred anti-wear additives for addition to the compositions of the present invention are the dihydrocarbyl dithiophosphate metal salts. They also provide some antioxidant activity. The zinc salts are most commonly used in lubricating oils in amounts of 0.1 to 10, preferably 0.2 to 2, weight percent, based upon the total weight of the lubricating oil composition. Salts of other metals, e.g. barium and cadmium, can also be used. They may be prepared in accordance with known techniques by first forming a dithiophosphoric acid, usually be reaction of an alcohol or a phenol with $P_2S_5$ and then neutralizing the dithiophosphoric acid with a suitable zinc compound.

Mixtures of alcohols may be used including mixtures of primary and secondary alcohols, secondary generally for importing improved antiwear properties, with primary giving improved thermal stability properties. Mixtures of the two are particularly useful. In general, any basic or neutral zinc compound could be used but the oxides, hydroxides and carbonates are most generally employed. Commercial additives frequently contain an excess of zinc due to use of an excess of the basic zinc compound in the neutralization reaction.

The zinc dihydrocarbyl dithiophosphates useful in the present invention are oil soluble salts of dihydrocarbyl esters of dithiphosphoric acids and may be represented by the following formula:

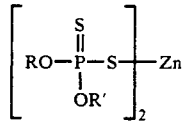

wherein R and R′ may be the same or different hydrocarbyl radicals containing from 1 to 18, preferably 2 to 12, carbon atoms and including radicals such as alkyl, alkenyl, aryl, aralkyl, alkaryl and cycloaliphatic radicals. Particularly preferred as R and R′ groups are alkyl groups of 2 to 8 carbon atoms. Thus, the radicals may, for example, be ethyl, n-propyl, i-propyl, n-butyl, i-butyl, sec-butyl, amyl, s-hexyl, i-hexyl, i-octyl, decyl, dodecyl, octadecyl, 2-ethylhexyl, nonyl-phenyl, dodecyl-cyclohexyl, methylcyclopentyl, propenyl, butenyl, etc. In order to obtain oil solubility, the total number of carbon atoms (i.e., R and R′) in the dithiophosphoric acid generally should be about 5 or greater and preferably 8 or greater.

Borated derivatives of the aforesaid antiwear agents may also be included in the compositions of the invention.

ADDITIONAL ANTIOXIDANTS

Antioxidants which are especially useful in lubricating oil compositions are based on oil-soluble copper compounds, e.g. in the form of a synthetic or natural carboxylic acid salt. By "oil-soluble" is meant that the compound is oil-soluble or solubilized under normal blending conditions in the oil or additive package. Examples of oil-soluble copper compounds include salts of $C_{10}$ to $C_{18}$ fatty acids such as stearic or palmitic acid; but unsaturated acids (such as oleic acid), branched carboxylic acids (such as naphthenic acids) of molecular weight from 200 to 500, dicarboxylic acids such as polyisobutenyl succinic acids, and synthetic carboxylic acids can all be used because of the acceptable handling and solubility properties of the resulting copper carboxylates.

Suitable oil-soluble copper dithiocarbamates have the general formula $(RR'N.CS.S)_nCu$; where n is 1 or 2 and R and R′ may be the same or different hydrocarbyl radicals containing from 1 to 18 carbon atoms each and including radicals such as alkyl, alkenyl, aryl, aralkyl, alkaryl and cycloaliphatic radicals. Particularly preferred as R and R′ groups are alkyl groups of 2 to 8 carbon atoms. Thus, the radicals may, for example, be ethyl, n-propyl, n-butyl, i-butyl, sec-butyl, amyl, sec-hexyl, i-hexyl, i-octyl, decyl, dodecyl, octadecyl, 2-ethylhexyl, nonyl-phenyl, dodecyl-phenyl, cyclohexyl, methylcyclopentyl, propenyl, butenyl, etc. In order to obtain oil solubility, the total number of carbon atoms (i.e., R and R′) generally should be about 5 or greater.

Copper salts of dithiophosphonic acids (as described hereinbefore in relation to antiwear additives), copper sulfonates, phenates and acetyl acetonates can also be used.

These antioxidants can be used in amounts such that, in the final lubricating composition, a copper concentration of from 5 to 500 ppm is present.

Other known oil-soluble or oil-dispersible, and preferably liquid, antioxidants may also be used in the compositions of the invention. Examples of such antioxidants include hindered phenols, which may contain sulphur, e.g. 4,4'-methylene bis (2,6-di(t-butyl)phenol) and 4,4'-thio bis (2,6-di(t-butyl)phenol); unhindered phenols which again may contain sulphur such as 2,2'-thio bis(4-nonyl phenol) and 2,2'-methylene bis (4-nonylphenol); diphenylamine derivatives such as 4,4'-dinonyl diphenylamine; phenothiazine derivatives, e.g. those containing higher alkyl substituents such as dioctyl and dinonyl phenothiazines; substituted beta-naphthylamines such as phenyl beta-naphthylamine and its alkylated derivatives; other amino aryl compounds such as for example 4,4'-bis(secbutylamino) diphenylmethane; dithiocarbonates such as zinc, nickel, copper, or molybdenum dithiocarbamates; and phosphosulphurized olefins, e.g. phosphosulphurized pinene.

CORROSION INHIBITORS AND METAL DEACTIVATORS

Corrosion inhibitors which act by deactivating metal parts with which they come in contact and/or as sulphur scavengers can also be used in the compositions of the invention. Examples of such agents include benzotriazole derivatives; thiadiazole compounds, e.g. 2,5-dimercapto 1,3,4-thiadiazole; mercaptobenzothiazole compounds in the form of amine salts, sulphonamides, thiosulphonamides, and condensates of mercaptobenzothiazole with amines and formaldehyde; salicylaldehyde/diamine condensation products; dialkylphosphites, e.g. dioleyl or di-2-ethylhexyl phosphite; trialkyl and triarylphosphites, e.g. tris(2-ethylhexyl), triphenyl or tri(4-nonylphenol) phosphites; and thiophosphonates such as triphenyl or trilauryl thiophosphonate or trilauryl tetrathiophosphonate.

FRICTION MODIFIERS AND FUEL ECONOMY AGENTS

Friction modifiers and fuel economy agents which are compatible with the other ingredients of the new compositions may also be included. Examples of such materials are glyceryl monoesters of higher fatty acids, e.g. glyceryl mono-oleate and esters of long-chain polycarboxylic acids with diols, e.g. the butane diol ester of a dimerized unsaturated fatty acid, and oxazoline compounds.

VISCOSITY INDEX IMPROVERS

Viscosity index improvers, or viscosity modifiers are typically polymers of number average molecular weight $10^3$ to $10^6$—for example ethylene copolymers or polybutenes. Viscosity index improvers may be modified to have dispersant properties an suitable viscosity index improver dispersants for use in compositions of the invention are described in, for example, European Specification No. 24146A, the disclosures of which are incorporated herein by reference, and include (a) polymers comprising monomer units derived from a $C_4$ to $C_{24}$ unsaturated ester of vinyl alcohol or a $C_3$ to $C_{10}$ unsaturated mono-or dicarboxylic acid and an unsaturated nitrogen-containing monomer having 4 to 20 carbon atoms;

(b) polymers comprising monomer units derived from a $C_2$ to $C_{20}$ olefin and an unsaturated $C_3$ to $C_{10}$ mono-or dicarboxylic acid neutralised with an amine, a hydroxyamine or an alcohol; and (c) polymers of ethylene with a $C_3$ to $C_{20}$ olefin further reacted by grafting a $C_4$ to $C_{20}$ nitrogen-containing monomer thereon or by grafting an unsaturated acid onto the polymer backbone and then reacting the carboxylic acid groups with an amine, hydroxy amine, or alcohol.

(The European specification also gives examples of various other additives referred to therein which may be used in accordance with the present invention.) These viscosity index improvers also have dispersant properties, as is preferred in accordance with the invention, although viscosity index improvers without dispersant properties may be used if desired.

Preferred viscosity index improvers with dispersant properties for use in the compositions of the present invention comprise a poly-olefin moiety to which is grafted an unsaturated carboxylic acid moiety, the carboxylic acid groups being reacted with an amine, hydroxyamine or alcohol.

The following Examples illustrate the invention.

EXAMPLES

The antioxidant effect of the substituted para-phenylene diamines used in the invention in lubricating oil has been demonstrated by the following accelerated oxidation test.

The lubricating oil used had the following composition:

| | |
|---|---|
| Viscosity Modifier | 6.9 wt % |
| Succinimide Dispersant | 4.5 wt % |
| Overbased Mg Sulphonate | 1.0 wt % |

These agents are all commercially available materials whose exact composition is not significant in the context of the present invention.

Ferric acetylacetonate (0.759 g) is dissolved in chloroform (100 ml). The lubricating oil (300 g) containing a measured amount of the antioxidant under test (or, in the case of the control, no antioxidant) is placed in an oxidation tube (e.g. as required for ASTM D953) and 2.5 ml of the ferric acetylacetonate solution are added (corresponding to 10 ppm of Fe in the oil). An air flow tube is inserted in the oil and air is blown gently through until the ferric acetylacetonate is thoroughly dispersed in the oil. The oxidation tube is then heated to 165° C. in a heating block and air is then passed through the heated oil at a rate of 1.7 liters/minute.

The viscosity of the oil is measured on a 5 ml sample after 16, 24, 40, 48 and 64 hours using a cone-and-plate (Haake) viscometer (PK 100 and RV 12 with cones PK 5 and PK 1).

The results obtained are shown in the following Table.

TABLE

| | | | Viscosity (CP) after | | | | | |
|---|---|---|---|---|---|---|---|---|
| | Antioxidant | Mass % | 0 | 16 | 24 | 40 | 48 | 64 hrs |
| | None | — | | 132 | 264 | >300 | | |
| A | Ethyl 702 | 1.0 | 63 | 91 | 160 | >300 | | |
| B | Irganox L-57 | 0.7 | 63 | 101 | 158 | >300 | | |
| C | Naugalube 438L | 0.5 | 63 | 87 | 151 | >300 | | |

TABLE-continued

| | Antioxidant | Mass % | Viscosity (CP) after 0 | 16 | 24 | 40 | 48 | 64 hrs |
|---|---|---|---|---|---|---|---|---|
| D | Rhein-Chemie Additin 40 | 0.5 | 64 | 66 | 113 | >300 | | |
| E | Rhein-Chemie Additin 35 | 0.5 | 63 | 63 | 80 | 156 | 241 | >300 |
| F | Naugalube 443 | 0.5 | 62 | 64 | 85 | 231 | >300 | |
| G | Santoflex 134 | 0.5 | 64 | 63 | 64 | 68 | 68 | 95 |
| H | Flexone 6H | 0.5 | 63 | 64 | 65 | 68 | 70 | 73 |

A is a hindered phenol.
B, C, D and E are alkylated diphenylamines
F is N,N'-diheptyl-para-phenylene diamine
G is N-(hexyl/heptyl)-N'-phenyl-para-phenylene diamine
H is N-(cyclohexyl)-N'-phenyl-para-phenylene diamine These results show that only the preferred substituted para-phenylene diamines G and H protect the lubricating oil against oxidation for over 64 hours in this test.

We claim:

1. A crankcase lubricating oil composition for use in an environment in which iron-catalyzed oxidation reactions can take place, which composition comprises lubricating oil and, as antioxidant, about 0.1 wt. % to about 5 wt. % of a para-phenylene diamine of the formula:

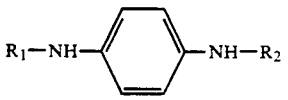

in which $R_1$ represents an aryl-containing radical selected from the group consisting of aryl radicals, aryl radicals substituted by one or more alkyl or alkenyl radicals of up to 20 carbon atoms each, and aryl-alkyl and aryl-alkenyl radicals with up to 20 carbon atoms in the alkyl or alkenyl moiety and optionally substituted on the aryl moiety by one or more alkyl or alkenyl radicals of up to 20 carbon atoms each, and $R_2$ represents a radical selected from the group consisting of alkyl and alkenyl radicals of up to 20 carbon atoms, and cycloalkyl and cycloalkenyl radicals of 5 to 7 carbon atoms optionally substituted by one or more alkyl or alkenyl radicals of up to 6 carbon atoms each, the said paraphenylene diamine being present as the free base or as an oil-soluble salt.

2. A composition as claimed in claim 1, wherein $R_2$ represents a cycloaliphatic radical as specified in claim 1.

3. A composition as claimed in claim 1, wherein $R_1$ represents an aryl radical, preferably a phenyl radical, optionally substituted by one or more alkyl or alkenyl radicals having up to 20 carbon atoms each.

4. A composition as claimed in claim 1, in which, in the said para-phenylene diamine, $R_1$ is a phenyl or alkylphenyl radical with 6 to 12 carbon atoms in the alkyl group, and $R_2$ is selected from the group consisting of alkyl radicals having 6 to 12 carbon atoms, and cyclohexyl radicals.

5. A composition as claimed in claim 1, in which, in the said para-phenylene diamine, $R_1$ is a phenyl radical and $R_2$ is a branched chain alkyl radical having 6 to 7 carbon atoms.

6. A composition as claimed in claim 1, containing 0.1 to 0.5% by weight of the said paraphenylene diamine antioxidant based on the total weight of the oil.

7. A composition as claimed in claim 1 which contains 1 to 10 weight percent of ashless dispersant, 0.1 to 5 weight percent of detergent, 0 to 2 weight percent of anti-wear additive, and optionally other additives.

8. The composition of claim 1 wherein $R_1$ represents a phenyl radical and $R_2$ represents a cyclohexyl radical.

9. A lubricating oil composition for use in an environment in which iron-catalyzed oxidation reactions can take place, which composition comprises lubricating oil and, as antioxidant, about 0.1 wt. % to about 5 wt. % of a paraphenylene diamine of the formula:

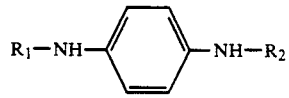

in which $R_1$ represents an aryl-containing radical selected from the group consisting of aryl radicals, aryl radicals substituted by one or more alkyl or alkenyl radicals of up to 20 carbon atoms each, and aryl-alkyl and aryl-alkenyl radicals with up to 20 carbon atoms in the alkyl or alkenyl moiety and optionally substituted on the aryl moiety by one or more alkyl or alkenyl radicals of up to 20 carbon atoms each, and $R_2$ represents a radical selected from the group consisting of alkyl and alkenyl radicals of up to 20 carbon atoms, and cycloalkyl and cycloalkenyl radicals of 5 to 7 carbon atoms optionally substituted by one or more alkyl or alkenyl radicals of up to 6 carbon atoms each, the said paraphenylene diamine being present as the free base or as an oil-soluble salt, the composition additionally comprising at least one member selected from the group consisting of anti-wear agents ashless dispersants, viscosity index improvers, and detergents.

10. A composition as claimed in claim 9 containing at least one member selected from the group consisting of viscosity index improvers, anti-wear additives, and other antioxidants.

11. A composition as claimed in claim 10, which also contains an ashless dispersant and/or a viscosity index improver dispersant, an antiwear agent.

12. A composition as claimed in claim 10, comprising, as ashless dispersant, the product of reacting a polymer of a $C_2$ to $C_{10}$ monoolefin with a number average molecular weight greater than about 700 with a $C_4$ to $C_{10}$ monounsaturated dicarboxylic acid or anhydride thereof and reacting the intermediate obtained with a member of the group consisting of amines, alcohols, amino-alcohols, mixtures thereof, and high molecular weight Mannich bases derived from a hydrocarbyl substituted mono- or poly- hydroxybenzene having a molecular weight greater than 1000.

13. A composition as claimed in claim 12, comprising as ashless dispersant, the product of reacting a polybutene with maleic anhydride and reacting the intermediate obtained with a polyalkylene amine containing 2 to 6 carbons per alkylene residue and 2 to 12 nitrogen atoms.

14. A composition as claimed in claim 9 comprising as the viscosity index improver dispersant a polyolefin moiety to which is grated an unsaturated carboxylic acid moiety, the carboxylic acid groups being reacted with an amine, hydroxyamine or alcohol.

15. A composition according to claim 9, comprising, as detergent, an over-based alkali metal or alkaline earth metal sulfonate or phenate.

16. A composition as claimed in claim 9, comprising, as detergent, a combination of detergents comprising calcium, magnesium and sodium salts.

17. A composition as claimed in claim 11, containing as antiwear additive a zinc dihydrocarbyldithiophosphate.

18. The composition of claim 9 comprising as detergent an over-based sulphonate or phenate of a metal selected from the group consisting of calcium, sodium and magnesium.

19. The composition of claim 9, wherein $R_2$ represents a cycloaliphatic radical.

20. The composition of claim 9, wherein $R_1$ represents an aryl radical, preferably a phenyl radical, optionally substituted by one or more alkyl or alkenyl radicals having up to 20 carbon atoms each.

21. The composition of claim 9 wherein the paraphenyl diamine, $R_1$ is a phenyl or alkyl-phenyl radical with 6 to 12 carbon atoms in the alkyl group and $R_2$ is selected from the group consisting of viscosity index improvers, ashless dispersants, detergents, anti-wear additives, and other anti-oxidants.

22. The composition of claim 9 wherein in the paraphenylene diamine, $R_1$ is a phenyl radical and $R_2$ is a branched chain alkyl radical having 6 to 7 carbon atoms.

* * * * *